US005799882A

United States Patent [19]

Klimpel

[11] Patent Number: 5,799,882

[45] Date of Patent: Sep. 1, 1998

[54] HYDROXY-CARBOXYLIC ACID GRINDING AIDS

[76] Inventor: Richard R. Klimpel, 4805 Oak Ridge Dr., Midland, Mich. 48640

[21] Appl. No.: 604,576

[22] Filed: Feb. 21, 1996

[51] Int. Cl.[6] ..... B02C 1/00; B02C 23/06

[52] U.S. Cl. ..... 241/16; 241/20; 241/21; 252/314; 252/61; 209/166

[58] Field of Search ..... 241/16, 20, 21; 252/314, 356, 61; 209/166

[56] References Cited

U.S. PATENT DOCUMENTS

| | | | |
|---|---|---|---|
| 1,234,288 | 7/1917 | Chapman | 209/166 |
| 2,204,063 | 6/1940 | Atwood | 241/20 |
| 2,259,457 | 10/1941 | Croll | 252/314 |
| 2,306,292 | 12/1942 | Clarke | 241/16 |
| 2,360,519 | 10/1944 | Scripture | 241/16 |
| 2,551,893 | 5/1951 | Morton | 241/20 |
| 3,156,420 | 11/1964 | Crowl | 241/16 |
| 3,902,602 | 9/1975 | Petrovich | 209/166 |
| 3,909,399 | 9/1975 | Petrovich | 209/166 |
| 3,951,849 | 4/1976 | Vickery et al. | 252/314 |
| 4,042,666 | 8/1977 | Rice et al. | 423/167 |
| 4,097,244 | 6/1978 | Burk, Jr. et al. | 44/624 |
| 4,162,044 | 7/1979 | Manfroy et al. | 241/16 |
| 4,274,599 | 6/1981 | Manfroy et al. | 241/16 |
| 4,298,399 | 11/1981 | Formica et al. | 106/413 |
| 4,368,116 | 1/1983 | Petrovich | 209/166 |
| 4,545,898 | 10/1985 | Hellsten | 209/166 |
| 4,578,148 | 3/1986 | Lindahl | 241/21 |
| 4,772,382 | 9/1988 | Bulatovic | 209/166 |
| 4,842,651 | 6/1989 | Ravet et al. | 106/499 |
| 5,030,340 | 7/1991 | Panzer et al. | 209/167 |
| 5,123,931 | 6/1992 | Good | 44/281 |
| 5,131,600 | 7/1992 | Klimpel | 241/16 |
| 5,402,894 | 4/1995 | Winterhoff | 209/166 |

FOREIGN PATENT DOCUMENTS 02-151666 6/1990 Japan .

OTHER PUBLICATIONS

PTO 97–2621, Kamiya et al., Antirust Pigment Compositions, JP 02–151666, (USPTO, Wash., DC Apr. 1997).

Database WPIDS, week 9029, London: Derwent Publications Ltd., An–90–221799, Class G02, JP02151666–A, (TAYCA Corp), Jun. 11, 1990.

Mineral & Metallurgical Processing RR. Klimpel & R.D Hansen Minerals & Metollurgical Processing Feb. 1989 vol. 6 No. 1 pp. 35–43.

"Reagents in Mineral Technology", Chapter 6, R. R. Klimpel, Grinding Aids Based on Slurry Rheology Control, (Marcel Dekker, Inc., NY, NY) (1988) Month unavailable, pp. 179–194.

*Primary Examiner*—Richard D. Lovering
*Assistant Examiner*—Daniel S. Metzmaier
*Attorney, Agent, or Firm*—Bernd W. Sandt

[57] ABSTRACT

The efficiency of grinding materials is improved by the addition of hydroxy-carboxylic acids of five to six carbon atoms contasining at least three hydroxyl groups and from one to two carboxyl grpous or their soluble salts as grinding aids. The grinding aids can be added as such or formed in situ by the oxidation of saccharides.

5 Claims, No Drawings

HYDROXY-CARBOXYLIC ACID GRINDING AIDS

BACKGROUND OF THE INVENTION

This invention is related to wet-grinding of particulate materials, such as mineral ores, to reduce the particle size of such materials in order to improve their suitability for further processing or use.

Reduction of the size of particulate solids is an important step in many processes. For example mineral ores are frequently subjected to particle size reduction prior to further processing steps such as froth flotation, mechanical separation, and pelletization. Grinding operations are usually carried out in mills such as ball, bead, rod,stirred, attrition, jet, autogenous or pebble mills depending on the degree of comminution desired. The grinding is usually accomplished in the presence of a liquid medium which in most instances is water.

In the processing of ores, an essential step is the size reduction or comminution of the ore to the size at which valuable metal grains are released from the gangue matrix. As the quality of ore available decreases, the degree of comminution necessary to release the metal-containing grains increases. This in turn increases the grinding cost to process the ore. Since the grinding process is very energy intensive, the increases in energy costs coupled with the need for additional grinding has resulted in grinding costs becoming a significant portion of the cost of processing minerals and other materials.

The amount of breakage per unit time (breakage kinetics) and mass transfer of grinding is normally controlled by the amount of water present or the concentration of the material in the mill. Water is an excellent medium for grinding because of its high polarity. When the mass transport of aqueous slurries through the mill decreases, corrective action is taken by either increasing the amount of water or decreasing the amount of solids entering the mill. These actions avoid overloading the mill, but decrease efficiency since fewer solids are ground per unit of time.

Various chemical agents that act as grinding aids have been employed in efforts to increase grinding efficiencies and economics. One way in which grinding efficiencies may be improved is by lowering the viscosity of a slurry of a given weight percent solid, especially if the weight percent solid loading is on the high side. Reducing the viscosity allows an increase in the concentration of solids that can be ground within a given unit of time. A suitable grinding aid must meet additional requirements, since grinding is a preliminary step in processing, which include the impact of the grinding aid on subsequent operations. Various dispersants and surfactants such as anionic polyelectrolytes, polysiloxane, organosilicones, glycols, amines, graphite and non-polar liquids have all been used with varying degrees of success. Although some of these grinding aids do in fact lower viscosities, the necessary concentration at which such lowering is accomplished makes their use cost-prohibitive and/or also creates an impact on further processing of the comminuted solids.

Chemical agents to effectively act as grinding aids (1) must absorb on enough of the solid surfaces available to affect the slurry viscosity; (2) must be able to affect the viscosity at low grinding aid concentrations or high solids to grinding aid ratios; (3) must not adversely affect downstream operations; (4) must be non-toxic and degradable; (5) must not increase and preferably decrease steel media wear resulting from corrosion or abrasion; and (6) must be able to function in hard water media commonly used in grinding operations.

Because of the large scale on which commercial grinding operations are carried out even an efficiency improvement of a few percentage points is of major economic significance.

It is an object of the present invention to provide grinding aids having the foregoing properties to an extent greater than grinding aids heretofore developed.

SUMMARY OF THE INVENTION

The present invention comprises a grinding composition and a process for wet-grinding particulate solids in the presence of a grinding aid to a smaller particle size wherein the grinding aid comprises at least one hydroxy-carboxylic acid of five to six carbon atoms, containing at least three hydroxyl groups and from one to two carboxylic acid groups and water-soluble salts of such hydroxy carboxylic acids. In contrast to prior art processes the process of the present invention results in smaller particles at the same concentrations or in increased throughput at the same particle size. Although the preferred solids comminuted are mineral ores and the preferred medium is water, the process of the present invention is not restricted to such. The hydroxy carboxylic acids of the present invention are employed in amounts effective to provide increased efficiency which will vary with the nature of the medium, the nature and concentration of the solid to be comminuted and the specific grinding aid involved.

DETAILED DESCRIPTION OF ILLUSTRATIVE EMBODIMENTS

The grinding method and compositions of the present invention employ hydroxy-carboxylic acids of five to six carbons containing at least three hydroxyl groups and from one to two carboxylic acid groups as grinding aids in the reduction of particle size of solids in the presence of a liquid medium. The mono- and dicarboxylic acids employed in the present invention are those obtained by the oxidation of monosaccharides or the hydrolysis and oxidation of di- and polysaccharides. Suitable acids include gluconic, saccharic, glyconic, mannoric, manaric, galactonic, galactaric, glycaric acid and mixtures thereof Any salt of such acids which is adequately soluble to form the carboxylate ion can also be employed in the present invention as a grinding aid. Preferred salts of these acids include the alkali metal and ammonium salts. In aqueous media it is preferred to use the acid in its soluble salt form. The specific structure of the acid does not affect its suitability in the present invention.

The acids and/or their salts can be added as such directly to the grinding composition or they can be formed in situ by adding a saccharide in combination with an oxidizing agent capable of oxidizing either the aldehyde group or the terminal hydroxyl group or both to a carboxylic acid group in the grinding environment. Suitable oxidizing agents are those heretofore employed in the such oxidations and include air or oxygen, water soluble metal and ammonium chromates, nitrates, halides, carbonates, peroxides, hypochlorites, chlorites, chlorates, permanganates or perchlorates, copper sulfate, caustic, lime, ammonia or mixtures thereof. Preferred oxidizing agents are cupric compounds, air, caustic, lime, ammonia and bleach, which is intended to include any composition containing a hypochlorite. Although it is generally preferred to employ the oxidizing agent in sufficient amounts to convert all of the saccharide added on a stoichiometric basis, the presence of excess oxidizing agent normally does not affect the grinding process or down-stream processes. Similarly the presence of unreacted saccharide does not interfere in the ability of the acids generated from the saccharide to improve the grinding process. In general a stoichiometric excess by a factor of 2 to 10 can be employed where the oxidation is incomplete. It is further possible to generate suitable acid compositions by the in situ hydrolysis and oxidation of disaccharides and polysaccharides if the grinding is conducted under sufficiently acid or caustic conditions to cause hydrolysis, although the hydrolysis of polysaccharides does not constitute a preferred method of practicing the invention.

The hydroxy-carboxylic acid grinding aids of the present invention are employed over a wide range of concentrations. Optimum concentrations depend on the specific nature of the grinding operation in which the hydroxy carboxylic acid or salt is to be employed and as already indicated is affected by the nature particle size and concentration of the solid to be comminuted, the degree of comminution, the nature of the liquid in which the grinding is to occur, and the particular acid composition involved. Additional factors to be considered include mill type, slurry volume, number and size of grinding media and mill rpm. Typically, the effective amount of grinding aid ranges from about 10 g to 3000 g per metric ton (Mt) of dry solid. Where the carboxylic acid is formed in situ it is preferable to employ larger amounts, up to 13 kg, than would be required as calculated on a stoichiometric conversion of the saccharide to the carboxylic acid or salt, since the yield resulting from the oxidation is usually less than quantitative. The maximum amount of grinding aid used is typically limited by economic restraints. Preferred concentrations generally are within the range of 50 to 1000 g of hydroxy-carboxylic acid per ton of dry solid. It is also possible to combine the grinding aid of the present invention with other established additives which then could affect the concentration in which the hydroxy-carboxylic acid is used.

The use of the grinding aids of the present invention is not limited to any particular solid to be comminuted and can be employed in the grinding of mineral ores, oil sands, tar sands, oil shale, cements, ceramics, pigments and coals. Examples of mineral oxide ores include those containing iron oxides, nickel oxides, phosphorus oxides, and transition metal oxides and oxides of elements of the Lanthanide series. Other oxygen containing minerals suitably ground by the process of the present invention include carbonates such as calcite, apatite or dolomite and hydroxides such as bauxite. Specific oxide containing ores include hematite, cuprite, valerite, calcite, talc, kaolin, spinel, corundum, azurite, rutile, magnetite, columbite, chromite, malachite, zincite, tungstite, uranite, and tantalite. Examples of sulfide ores which can be employed in the present invention include chalcopyrite, chalcocite, galena, pyrite, sphalerite and landite.

Although the overwhelming utility of the grinding aids of the present invention is in the grinding of particulates in aqueous media, the grinding aids can also be employed in non-aqueous media such as alcohols, ethers and esters. In organic liquids the carboxylic acids are preferably employed in the acid form which provides for greater solubility in organic media. The solids concentration of the particulate in the liquid slurry can vary widely depending on the particular grinding conditions selected and the degree of comminution desired. In general the concentration will be greater than 20 volume percent and up to 95 volume percent. Generally optimum viscosities in the grinding are obtained at concentrations of 30 to 60 volume percent.

The type of wet grinding devices in which the grinding aids of the present invention can be employed include the ball, bead, rod, stirred, agitation, jet, autogenous or pebble mills heretofore used in the grinding of particulates. The media employed to enhance the autogeneous breakage of the solid particles can assume a variety of forms including balls, rods, bars, cylinders, pebbles and slugs and can be made from a variety of materials including steel, steel alloys, marble, natural ores or ceramics. The media are generally of sufficient size so that they do not affect the inherent viscosity of the slurry to be ground.

The grinding process of the present invention may be conducted at the natural pH of the slurry or at a modified pH. In determining the optimum pH, one skilled in the art will need to consider the effect of pH changes on subsequent processing steps.

The grinding efficiency may be determined in batch grinding operations from the increase in the amount of particulate solid of desired particle size as a result of the addition of the grinding aid, and/or in continuous grinding operations also by an increase in throughput at constant particle size, all other conditions being maintained the same. Particle size is generally determined by the amount passing a screen of certain size using U.S. Standard mesh sizes such as for example the percentage of the total solids passing a 170 mesh (90 microns) screen. Normally as the amount of solids in the slurry is increased, the grinding efficiency of the grinding process is decreased. The improvement resulting from the use of the grinding aids of the present invention can therefore be demonstrated by showing a higher conversion to the desired particle size at the same concentration, by the same conversion at a higher slurry solids concentration or by a combination of both.

The following examples are provided to illustrate the invention and are not to be construed as limiting such. Unless otherwise stated all parts and percentages are by weight.

EXAMPLE 1

The grinding runs described in Table I were conducted in a cylindrical steel ball mill having a diameter of 20.3 cm, a length of 22.9 cm, and an internal volume of 7413 $cm^3$. The mill was fitted with lifter bars and a stainless steel ball charge of 110, 2.54 cm diameter balls and 30, 3.81 cm diameter balls. The volume of the slurry was maintained constant in all runs at 1120 $cm^3$ even though the concentration of the solids in the slurry was changed as indicated in the Table. The grinding aid in an amount in grams per metric ton (g/Mt) was added at the beginning of the run. The mill was rotated at a speed of 60 rpm and the runs were conducted for a period of thirty minutes. The solid employed in the runs was a Minnesota iron ore having a density of 3.3, 100% of which passed a 10 U.S. mesh (2000 microns) screen and 13.61% passed a 170 U.S. mesh (90 microns) screen. The results stated are averages where replicated, the number of replication being indicated in parenthesis next to the run number. The experimental error associated with the final data column of Table 1 is +/−1.2%. The ground solids were separated and dried and a representative 10 to 15 g sample of the material was isolated and sieved through a 170 mesh screen to establish the changes in the particle size and the efficiency of the run as compared to the highest value obtained without an additive.

TABLE I

| Run No | Grinding Aid | Dose g/Mt | Feed Wt in g | Wt % solids | Wt %< 170 Mesh | Net Solid ground in g <170 Mesh | % change v. Max |
|---|---|---|---|---|---|---|---|
| | | Starting Materials | | | | Product | |
| 1* | none | — | 1295 | 64 | 91.89 | 1013.7 | −17.0 |
| 2* | none | — | 1449 | 68 | 90.20 | 1109.8 | −9.1 |
| 3(2)* | none | — | 1619 | 72 | 88.93 | 1219.4 | −0.2 |
| 4(2)* | none | — | 1811 | 76 | 81.06 | 1221.5 | Max |
| 5(3)* | none | — | 2025 | 80 | 70.70 | 1156.1 | −5.4 |
| 6* | caustic | 227 | 2025 | 80 | 71.26 | 1167.4 | −4.4 |
| 7* | bleach | 227 | 2025 | 80 | 72.68 | 1196.2 | −2.1 |
| 8* | lime | 227 | 2025 | 80 | 70.06 | 1143.1 | −6.4 |
| 9* | Na polyacrylate | 227 | 1619 | 72 | 89.45 | 1227.8 | +0.5 |
| 10* | Na polyacrylate | 227 | 1811 | 76 | 81.97 | 1238.0 | +1.4 |
| 11* | Na polyacrylate | 227 | 2025 | 80 | 73.76 | 1218.0 | −1.0 |
| 12* | Na polyacrylate | 454 | 2025 | 80 | 76.89 | 12.81.4 | +4.9 |
| 13* | Na polyacrylate/lime | 454/227 | 2025 | 80 | 72.39 | 1190.3 | −2.6 |
| 14 | Na polyacrylate | 908 | 2025 | 80 | 79.25 | 1309.3 | +7.2 |
| 15* | Na citrate | 252 | 1811 | 76 | 81.91 | 1236.9 | +1.3 |
| 16* | Na citrate | 454 | 1811 | 76 | 82.14 | 1241.1 | +1.6 |
| 17(3)* | Na citrate | 454 | 2025 | 80 | 75.46 | 1252.5 | +2.5 |
| 18* | Na citrate/lime | 454/227 | 2025 | 80 | 71.43 | 1170.9 | −4.1 |
| 19 | Na gluconate | 227 | 1811 | 76 | 83.55 | 1266.6 | +3.7 |
| 20(2) | Na gluconate | 454 | 1811 | 76 | 83.85 | 1272.0 | +4.1 |
| 21(2) | Na gluconate | 227 | 2025 | 80 | 75.50 | 1268.7 | +3.9 |
| 22(3) | Na gluconate | 454 | 2025 | 80 | 77.64 | 1296.6 | +6.1 |
| 23 | Na gluconate | 908 | 2025 | 80 | 79.25 | 1329.2 | +8.8 |
| 24 | Na gluconate/lime | 454/227 | 2025 | 80 | 76.86 | 1280.8 | +4.9 |
| 25 | Na gluconate/glucose | 227/227 | 2025 | 80 | 77.12 | 1286.1 | +5.3 |
| 26 | Na gluconate/tartaric acid | 227/227 | 2025 | 80 | 77.42 | 1292.2 | +5.8 |
| 27 | Na gluconate/citric acid | 227/227 | 2025 | 80 | 76.40 | 1271.5 | +4.1 |
| 28 | Na gluconate/Na poly-acrylate | 227/227 | 2025 | 80 | 75.91 | 1261.6 | +3.3 |
| 29 | galactaric acid | 454 | 2025 | 80 | 76.73 | 1278.2 | +4.6 |
| 30 | galactaric acid/lime | 454/227 | 2025 | 80 | 76.56 | 1274.9 | +4.4 |
| 31 | glucaric acid | 454 | 2025 | 80 | 77.53 | 1294.7 | +6.0 |
| 32 | mannonic/mannaric acids | 227/227 | 2025 | 80 | 77.40 | 1291.7 | +5.7 |
| 33 | galactonic acid | 227 | 2025 | 80 | 76.59 | 1275.3 | +4.4 |
| 34 | glucose | 454 | 2025 | 80 | 73.32 | 1209.1 | −1.0 |
| 35 | glucose/ammonia | 454/227 | 2025 | 80 | 74.29 | 1228.8 | +0.6 |
| 36 | glucose/Na carbonate | 454/227 | 2025 | 80 | 74.06 | 1224.1 | +0.2 |
| 37 | glucose/caustic | 454/227 | 2025 | 80 | 74.79 | 1238.9 | +1.4 |
| 38 | glucose/lime | 454/227 | 2025 | 80 | 74.44 | 1231.8 | +0.8 |
| 39 | glucose/Cu sulfate | 454/227 | 2025 | 80 | 74.96 | 1242.3 | +1.7 |
| 40(2) | glucose | 908 | 2025 | 80 | 74.14 | 1225.7 | +0.3 |
| 41(2) | glucose/caustic | 908/227 | 2025 | 80 | 76.46 | 1272.7 | +4.2 |
| 42 | glucose/Cu sulfate | 908/227 | 2025 | 80 | 76.47 | 1272.9 | +4.2 |
| 43 | glucose/bleach | 908/227 | 2025 | 80 | 76.69 | 1277.4 | +4.6 |
| 44 | glucose/nitric acid | 908/227 | 2025 | 80 | 77.56 | 1293.4 | +5.9 |
| 45 | glucose/lime | 908/227 | 2025 | 80 | 76.63 | 1277.4 | +4.6 |
| 46 | glucose/caustic | 1816/227 | 2025 | 80 | 79.03 | 1324.8 | +8.5 |
| 47 | sucrose | 454 | 2025 | 60 | 73.45 | 1212.4 | −0.7 |
| 48 | sucrose/caustic | 454/227 | 2025 | 80 | 76.43 | 1272.1 | +4.1 |
| 49 | sucrose/lime | 454/227 | 2025 | 80 | 75.88 | 1261.0 | +3.2 |
| 50 | sucrose/bleach | 454/227 | 2025 | 80 | 75.53 | 1253.9 | +2.7 |
| 51 | fructose | 454 | 2025 | 80 | 73.54 | 1213.6 | −0.6 |
| 52 | fructose/caustic | 454/227 | 2025 | 80 | 75.65 | 1256.2 | +2.8 |
| 53 | fructose/lime | 454/227 | 2025 | 80 | 75.95 | 1262.4 | +3.3 |
| 54 | maltose | 454 | 2025 | 80 | 73.11 | 1204.9 | −1.4 |
| 55 | maltose/caustic | 454/227 | 2025 | 80 | 75.56 | 1254.5 | +2,7 |
| 56 | maltose/lime | 454/227 | 2025 | 80 | 75.74 | 1258.1 | +3.0 |
| 57 | mannose | 454 | 2025 | 80 | 75.50 | 1253.3 | +2.6 |
| 58 | mannose/nitric acid | 454/227 | 2025 | 80 | 78.57 | 1315.4 | +4.6 |
| 59 | mannose/bleach | 454/227 | 2025 | 80 | 77.19 | 1287.5 | +5.4 |

*Comparative example

Runs 1 to 18 demonstrate the results obtainable in the absence of an additive and also in the presence of prior art additives. Although sodium polyacrylate (9000 molecular weight) is an effective grinding aid (Runs 12, 14) the effectiveness is lost in the presence of calcium ions (Run 13). The same effect is observed with another known grinding aid, sodium citrate (Runs 15–18). Since alkaline earth metal ions, and particularly calcium are either frequently present in water used in grinding or dissolve in the water from the solid being ground, the use of these prior art grinding aids is severely limited. The grinding aids of the present invention on the other hand are extremely effective in the presence of alkaline earth metal ions in the grinding slurry.

Runs 19 to 33 show results obtained with the preferred grinding aids of the present invention. The hydroxy carboxylic acids of the present invention can be employed either as the acid (Runs 29–33) or as a water soluble salt of the acid(Runs 19–28).

Runs 34 to 59 illustrate the results obtained using in situ formed hydroxy carboxylic acids by the reaction of a saccharide with an oxidizing agent. Since the reaction is not quantitative, regardless of the oxidizing agent employed, better results are obtained at higher concentrations of additives as compared to the hydroxy carboxylic acid itself. The examples also show the difference in results obtained with poor oxidizing agents, such as air (Runs 34, 40, 47, 51, 54 and 57) and the better oxidizing agents, such as sodium carbonate (Run 36), caustic (Runs 37, 41, 46, 48, 52, and 54), bleach (Runs 43, 50, and 59), ammonia (Run 35), cupric sulfate (Runs 39 and 42) and nitric acid (Run 58).The data in Table I also show that lime rather than being deleterious acts as an oxidizing agent, improving the performance of the saccharide (Runs 38, 45, 49, 53 and 56). Although both the aldose and the ketose form of saccharide can be employed, the aldose form, e.g., glucose and mannose, is preferred, since such appear to oxidize more readily to the acid in a grinding environment.

EXAMPLE 2

The procedure of Example 1 was repeated except that the solid was a particulate Arizona copper sulfide ore having a specific gravity of 2.7, in which 100 weight % passed a 10 mesh U.S. screen and 18.95 weight % passed a 170 mesh U.S. screen. As in Example 1, a standard was established, based on the best performance in the absence of a grinding aid, against which to measure the effectiveness of an additive. The experimental error associated with the final column data of Table II is +/−2.1%. The results are set forth in Table II and demonstrate that the efficacy of the grinding aids of the present invention is not limited to the marterial of Example 1.

TABLE II

| Run No | Grinding Aid | Dose g/Mt | Feed Wt in g | Wt % solids | Wt %< 170 Mesh | Solid in g >170 Mesh | % change v. Max |
|---|---|---|---|---|---|---|---|
| | | | Starting Materials | | | Product | |
| 1* | none | — | 1800 | 60 | 70.28 | 923.9 | −1.0 |
| 2* | none | — | 1877 | 64 | 68.67 | 933.2 | Max |
| 3* | none | — | 1959 | 68 | 65.68 | 915.4 | −1.9 |
| 4* | none | — | 2025 | 72 | 61.20 | 866.1 | −7.2 |
| 5* | Na polyacrylate | 454 | 1959 | 68 | 68.87 | 977.9 | +4.8 |
| 6* | Na polyacrylate/lime | 454/227 | 1959 | 68 | 66.44 | 930.3 | −0.3 |
| 7* | Na polyacrylate/lime | 454/227 | 2025 | 72 | 62.63 | 895.4 | −4.1 |
| 8* | Na citrate | 454 | 1959 | 68 | 69.23 | 985.0 | +5.6 |
| 9* | Na citrate/lime | 454/227 | 1959 | 68 | 66.14 | 924.5 | −0.9 |
| 10* | Na citrate/lime | 454/227 | 2025 | 72 | 62.66 | 896.1 | −4.0 |
| 11(3) | Na gluconate | 454 | 1959 | 68 | 70.54 | 1010.6 | +8.3 |
| 12 | Na gluconate/lime | 454/227 | 1959 | 68 | 69.70 | 994.2 | +6.5 |
| 13 | Na gluconate/lime | 454/227 | 2025 | 72 | 66.24 | 969.4 | +3.9 |
| 14 | galactaric acid/lime | 454/227 | 2025 | 72 | 66.96 | 972.2 | +4.2 |
| 15 | glycaric acid/lime | 454/227 | 2025 | 72 | 66.91 | 971.2 | +4.1 |
| 16 | glucose | 454 | 1959 | 68 | 66.60 | 933.5 | 0.0 |
| 17 | glucose/lime | 454/227 | 1959 | 68 | 70.22 | 1004.4 | +7.6 |
| 18 | glucose/caustic | 454/227 | 1959 | 68 | 71.98 | 1038.9 | +10.2 |
| 19 | glucose | 454 | 2025 | 72 | 65.44 | 941.4 | +0.9 |
| 20 | glucose/caustic | 454/227 | 2025 | 72 | 66.81 | 981.1 | +5.1 |
| 21(3) | glucose/lime | 454/227 | 2025 | 72 | 66.22 | 969.0 | +3.8 |
| 22 | glucose/lime | 908/227 | 2025 | 72 | 68.61 | 1018.0 | +9.1 |
| 23 | sucrose | 454 | 2025 | 72 | 63.18 | 906.7 | −2.8 |
| 24 | sucrose/caustic | 454/227 | 2025 | 72 | 66.49 | 947.6 | +4.4 |
| 25 | sucrose/lime | 454/227 | 2025 | 72 | 66.76 | 980.1 | +5.0 |
| 26 | sucrose/lime | 908/227 | 2025 | 72 | 68.33 | 1012.3 | +8.4 |
| 27 | fructose | 454 | 2025 | 72 | 63.42 | 911.6 | −2.3 |
| 28 | fructose/caustic | 454/252 | 2025 | 72 | 65.90 | 950.7 | +1.9 |
| 29 | fructose/lime | 454/252 | 2025 | 72 | 66.82 | 969.4 | +3.9 |
| 30 | fructose/lime | 908/252 | 2025 | 72 | 67.77 | 988,6 | +5.9 |

*Comparative examples, not examples of the invention claimed
*Comparative example

EXAMPLE 3

Using a stainless steel, rotating rod mill having internal dimensions of 6 cm in diameter and 10 cm in length aqueous titanium dioxide pigment slurries were ground for a period of 40 minutes. The volume of the solids in the slurry was held constant at 45 volume %. The rod mill contained six, 1.25 cm steel rods and was rotated at a speed of 72 rpm. The efficacy of the grinding was measured by the change in material passing through a 200 mesh U.S. screen (75 microns) before and after the run. The runs containing grinding aids of the present invention (Runs 2–6) are compared to a standard using just water and a run containing only caustic (Runs 1, 7) in Table III. The results demonstrate the major improvement in efficiency obtained with the grinding aids of the present invention.

EXAMPLE 4

Following the procedure of Example 3 and using the same equipment, alumina ceramic material was ground at the conditions set forth in Table III. The improvement resulting from the use of the grinding aids of the present invention is similarly set forth in Table III (Runs 8–12).

EXAMPLE 5

Following the procedure of Example 3 and using the same equipment, cement clinker was ground at the conditions set forth in Table III. The improvement resulting from the use of the grinding aids of the present invention is similarly set forth in Table III (Runs 13–18).

EXAMPLE 6

Following the procedure of Example 3 and using the same equipment, bituminous coal was ground at the conditions set forth in Table III. The improvement resulting from the use of the grinding aids of the present invention is similarly set forth in Table III (Runs 19–25).

TABLE III

| Run No | Additive | Dose g/Mt | %<200 Mesh in Feed | %<200 Mesh in Product | % increase over base |
|---|---|---|---|---|---|
| Example 3 | | | | | |
| 1* | none | — | 37.41 | 68.73 | base |
| 2 | gluconic acid | 227 | 37.41 | 76.11 | +7.38 |
| 3 | gluconic acid | 454 | 37.41 | 81.40 | +12.67 |
| 4 | gluconic acid | 908 | 37.41 | 83.05 | +14.32 |
| 5 | glucose | 454 | 37.41 | 72.74 | +4.01 |
| 6 | glucose/caustic | 454/.113 | 37.41 | 74.90 | +6.17 |
| 7* | caustic | 113 | 37.41 | 69.40 | +0.67 |
| Example 4 | | | | | |
| 8 | none | — | 58.14 | 83.33 | base |
| 9 | gluconic acid | 227 | 58.14 | 90.48 | +7.15 |
| 10 | glucose | 454 | 58.14 | 85.14 | +1.81 |
| 11 | glucose/caustic | 454/113 | 58.14 | 89.60 | +6.27 |
| 12* | caustic | 113 | 58.14 | 83.99 | +0.66 |
| Example 5 | | | | | |
| 13 | none | — | 67.33 | 89.74 | base |
| 14 | gluconic acid | 227 | 67.33 | 95.36 | +5.62 |
| 15 | glucose | 454 | 67.33 | 92.22 | +2.48 |
| 16 | glucose/caustic | 454/113 | 67.33 | 94.70 | +4.96 |
| 17 | glucose/caustic | 908/227 | 67.33 | 96.77 | +7.03 |
| 18* | caustic | 227 | 67.33 | 90.68 | +0.94 |
| Example 6 | | | | | |
| 19* | none | — | 31.76 | 72.49 | base |
| 20 | gluconic acid | 227 | 31.67 | 73.93 | +1.44 |
| 21 | gluconic acid | 454 | 31.76 | 75.37 | +2.88 |
| 22 | glucose | 227 | 31.76 | 72.79 | +0.60 |
| 23 | glucose | 454 | 31.76 | 73.20 | +0.71 |
| 24 | glucose/caustic | 454/113 | 31.67 | 73.80 | +1.31 |
| 25* | caustic | 113 | 31.67 | 72.99 | +0.57 |

*Comparative example

EXAMPLE 7

Four grinding mills, each 13 cm in diameter and 20 cm in length, were each filled with 400 g of one cm diameter plain iron balls as media, similar to the media used in industrial mills. The mills were then each loaded with 200 g of minus 10 mesh U.S. screen Minnesota iron oxide ore and rotated on a roller bar table drive at 40 rpm for 24 days. In addition 50 g of sodium gluconate per Mt of iron ore was added to the second mill at the beginning, and at day 7, 13 and 19. 100 g glucose and 25 g caustic portions per Mt of iron ore were added to the third mill using the same schedule as for the second mill. 50 g portions of sodium citrate per Mt of iron ore were added to the fourth mill again as in the second mill. After 24 hours the media in each mill was then passed through a sieve having 0.6 cm openings. The weight of the media having diameters greater than 0.6 cm was then measured and compared to the original weight of the media. In the first mill 376.62 g of media was retained by the sieve, in the second 394.03 g, in the third 390.05 g and in the fourth 374.15 g. The media wear in the first run was therefore 5.84%, in the second 1.49%, 2.49% in the third and 6.46% in the fourth, demonstrating that the hydroxy carboxylic acids of the present invention not only increase the efficiency of the grinding process but also result in less wear, either in the absence of the acid or in the presence of prior art additives.

EXAMPLE 8

Using a standard Wemco mechanical flotation machine of 2.5 liter capacity ground slurries of the copper ore of Example 2 were tested in froth flotation with 50 g/Mt of dialkyl thionocarbamate as the collector. Lime was added to increase the pH to 10.5 and 10 g/Mt of polyglycol methyl ether, molecular weight of 250, was added to provide bubble stability. The machine was operated for a period of 5 minutes at 1250 rpm. The slurries from Example 2 listed in the table below were diluted to 40% solids by weight before the separation. After flotation, the froth concentrate and the remaining material in the bowl were dried, weighed, metal assays performed using a plasma analytical device, and standard metallurgical calculations for recovery performed. The feed assay of the copper content of the ore was 0.82%. The results are set forth in Table IV.

TABLE IV

| Ex. 2 Run No. | Additive | Dosage in g/Mt | % Cu recovery | % increase in Cu recovery | % Cu grade |
|---|---|---|---|---|---|
| 4* | — | — | 83.21 | — | 8.14 |
| 13 | Na gluconate/lime | 454/227 | 85.76 | +2.55 | 9.19 |
| 21 | glucose/lime | 454/227 | 84.39 | +1.18 | 8.60 |
| 22 | glucose/lime | 908/227 | 85.47 | +2.26 | 9.28 |
| 7* | Na polyacrylate/lime | 454/227 | 83.74 | +0.53 | 8.33 |
| 10* | Na citrate/lime | 454/227 | 83.61 | +0.40 | 8.35 |
| 4** | Na gluconate/lime** | 454/227 | 83.49 | +0.28 | 7.96 |
| 13*** | Na gluconate/lime | 454/227 | 37.14 | −46.07 | 3.61 |

*Comparative Example
**Additive added to flotation cell, not grinding mill
*Thionocarbamate collector not added The foregoing example demonstrates the beneficial effect of the grinding aids of the present invention in down-stream processes of ground slurries such as froth flotation, which is in addition to the benefits derived in the grinding process itself As shown in Table IV, metal recovery can be increased by more than 2% which is highly significant economically due to the large tonnage of ore being processed commercially. As demonstrated, the adverse affect of calcium ions on prior art grinding aids, such as polyacrylates and citrates, in the grinding process is carried forward into down-stream processes. The Table further demonstrates that the down-stream benefits of the present invention are not accomplished if the grinding aid is added to just the down-stream process (Runs 4  compared to Run, 4*).

EXAMPLE 9

Using a 20 cm diameter, vibrating 170 mesh U.S. screen, (90 microns ) 100 g of slurries obtained in Example 1 were sieved for a period of 10 minutes without first drying the ground material, to establish the ability of the slurry to be classified using industrial practices. Table V compares the actual, as determined by the procedure of Example 1, content of less than 170 mesh U.S. screen (90 microns) ground solid obtained with that measured using the higher throughput classification method and calculates the loss in efficiency resulting from such.

TABLE V

| Ex. 1 Run No. | Additive | Actual wt. % <170 Mesh | Meas. % wt. <170 Mesh | % Loss |
|---|---|---|---|---|
| 5* | — | 70.70 | 64.58 | 6.12 |
| 21 | Na gluconate | 75.50 | 72.06 | 3.44 |
| 22 | Na gluconate | 77.64 | 76.11 | 1.53 |
| 37 | glucose | 74.79 | 72.85 | 1.94 |

*Comparative example

The foregoing example demonstrates the improved ability of slurries obtained with the grinding aids of the present invention to be classified which is believed to result from the greater fluidity imparted to ground slurries through the addition of the hydroxy-carboxylic acids employed in the present invention. Given the industrial scale on which grinding operations are conducted the improvements apparent from Table V are of extreme importance. The same type of results are obtained through use of the grinding aids of the present invention in other classification devices, including hydrocyclones.

What is claimed is:

1. A process for wet grinding of solids, which comprises grinding an aqueous slurry of a particulate solid selected from the class consisting of mineral ores, ceramic, pigment and coal, said slurry containing from 20 to 95 percent by volume of said solid, in the presence of a grinding aid consisting essentially of a hydroxy-carboxylic acid having from 5 to 6 carbon atoms, at least three hydroxyl groups and one or two carboxylic acid groups or soluble salts of such carboxylic acids in concentrations effective to act as a grinding aid, wherein the hydroxy-carboxylic acid or its soluble salt is formed in situ by the oxidation of a saccharide having from five to six carbon atoms and at least three hydroxyl groups and whereby a smaller particle size or a greater throughput at the same particle size is obtained as compared to grinding in the absence of such grinding aid.

2. The process of claim 1 wherein the saccharide is selected from the group consisting of ribose, arabinose, xylose, lyxose, allose, altrose, glucose, mannose, gulose, idose, galactose, ribulose, xylulose, psicose, fructose, sorbose, tagatose and mixtures thereof.

3. The process of claim 1 wherein the oxidizing agent is selected from the group consisting of air, oxygen, halogen, ammonia, nitric acid, oxygen containing chlorine salts of alkali metals, oxygen containing chromium salts of alkali metals, alkali metal carbonates, peroxides, permanganates, copper sulfate, lime, caustic and mixtures thereof.

4. The process of claim 2 wherein the liquid medium is aqueous, the saccharide is glucose, sucrose, fructose, mannose or a mixture thereof and forms a water soluble salt.

5. In a process of recovering metals from ore containing said metals comprising grinding and froth flotation, the improvement comprising grinding the ore prior to froth flotation in the presence of a grinding aid which is a hydroxy-carboxylic acid of five to six carbon atoms containing at least three hydroxyl groups and from one to two carboxylic acid groups or its water soluble salt.

* * * * *